US011047235B2

(12) United States Patent
Garcia et al.

(10) Patent No.: US 11,047,235 B2
(45) Date of Patent: Jun. 29, 2021

(54) CUTTING APPARATUS

(71) Applicant: SANDVIK INTELLECTUAL PROPERTY AB, Sandviken (SE)

(72) Inventors: Luis Garcia, Zeltweg (AT); Guenther Staber, Murau (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/606,193

(22) PCT Filed: Mar. 30, 2018

(86) PCT No.: PCT/EP2018/058273
§ 371 (c)(1),
(2) Date: Oct. 17, 2019

(87) PCT Pub. No.: WO2018/192764
PCT Pub. Date: Oct. 25, 2018

(65) Prior Publication Data

US 2020/0131904 A1 Apr. 30, 2020

(30) Foreign Application Priority Data

Apr. 18, 2017 (EP) ..... 17166804

(51) Int. Cl.
*E21D 9/10* (2006.01)
*E21C 27/12* (2006.01)

(52) U.S. Cl.
CPC ..... *E21D 9/104* (2013.01); *E21C 27/124* (2013.01); *E21D 9/102* (2013.01)

(58) Field of Classification Search
CPC ..... E21D 9/104; E21D 9/1006; E21D 9/1013; E21D 9/102; E21D 9/1026; E21D 9/1033;
(Continued)

(56) References Cited

U.S. PATENT DOCUMENTS 2,230,569 A * 2/1941 Howard ..... E21B 10/16 175/377
4,005,905 A 2/1977 Dubois
(Continued)

FOREIGN PATENT DOCUMENTS

AU 2015203867 A1 7/2015
DE 202111050143 U1 10/2012
(Continued)

*Primary Examiner* — Janine M Kreck
*Assistant Examiner* — Michael A Goodwin
(74) *Attorney, Agent, or Firm* — Corinne R. Gorski

(57) ABSTRACT

A cutting head for cutting apparatus suitable for creating tunnels or subterranean roadways and the like. The cutting head includes a rotatable cutting head body and a plurality of cutting units mounted thereon. The cutting units include at least first and second different types of cutting units. The first type of cutting unit has a first rotatable cutter having a first disc body and a first arrangement of buttons for abrading rock. The first buttons are mounted in a radially peripheral portion of the disc body and protrude outwardly therefrom. The second type of cutting unit has a second rotatable cutter having a second disc body and a second arrangement of buttons. The second buttons are mounted in a radially peripheral portion of the disc body and protrude outwardly therefrom. The different types of cutting units differ from one another by at least the arrangements of their buttons.

13 Claims, 13 Drawing Sheets

(58) Field of Classification Search
CPC ..... E21C 27/126; E21C 27/02; E21C 27/124; E21C 27/128
USPC ..... 299/85.1
See application file for complete search history.

(56) References Cited

U.S. PATENT DOCUMENTS

| | | | | |
|---|---|---|---|---|
| 4,441,566 | A * | 4/1984 | Pessier | E21B 10/52 175/374 |
| 6,367,569 | B1 * | 4/2002 | Walk | E21B 10/12 175/373 |
| 9,574,405 | B2 | 2/2017 | Cariveau et al. | |
| 2003/0230925 | A1 | 12/2003 | Oishi | |
| 2013/0126246 | A1 * | 5/2013 | Yang | E21B 10/16 175/374 |

FOREIGN PATENT DOCUMENTS

| | | | | |
|---|---|---|---|---|
| EP | 2594728 | A1 | 5/2013 | |
| WO | WO-02066793 | A1 * | 8/2002 | E21C 25/18 |
| WO | 2010050872 | A1 | 5/2010 | |
| WO | 2011093777 | A1 | 8/2011 | |
| WO | 2012156841 | A2 | 11/2012 | |
| WO | 2012156842 | A2 | 11/2012 | |
| WO | 2012156884 | A2 | 11/2012 | |
| WO | 2014090589 | A2 | 6/2014 | |
| WO | 2016055087 | A1 | 4/2016 | |

* cited by examiner

CUTTING APPARATUS

RELATED APPLICATION DATA

This application is a § 371 National Stage Application of PCT International Application No. PCT/EP2018/058273 filed Mar. 30, 2018 with priority to EP 17166804.9 filed Apr. 18, 2017.

FIELD OF INVENTION

The present invention relates to rock cutting apparatus suitable for creating tunnels or subterranean roadways and in particular, although not exclusively, to undercutting apparatus in which a plurality of rotating heads are capable of being slewed laterally outward and raised in the upward and downward direction during forward cutting.

BACKGROUND ART

A variety of different types of excavation machines have been developed for cutting drifts, tunnels, subterranean roadways and the like in which a rotatable head is mounted on an arm that is in turn movably mounted at a main frame so as to create a desired tunnel cross sectional profile. WO2012/156841, WO 2012/156842, WO 2010/050872, WO 2012/156884, WO2011/093777, DE 20 2111 050 143 U1 all described apparatus for mill cutting of rock and minerals in which a rotating cutting head forced into contact with the rock face as supported by a movable arm. In particular, WO 2012/156884 describes the cutting end of the machine in which the rotatable heads are capable of being raised and lowered vertically and deflecting in the lateral sideways direction by a small angle in an attempt to try enhance the cutting action.

WO 2014/090589 describes a machine for digging roadways tunnels and the like in which a plurality of cutting heads are movable to dig into the rock face via a pivoting arcuate cutting path. US 2003/0230925 describes a rock excavator having a cutter head mounting a plurality of annular disc cutters suitable to operate in an undercutting mode.

However, conventional cutting machines are not optimised to cut hard rock having a strength typically beyond 120 MPa whilst creating a tunnel or subterranean cavity safely and reliably of desired cross sectional configuration. WO2016/055087 describes a type of machine that is addresses some of these problems, however the inventors have determined that the arrangement of the cutting heads on these devices is not optimised. For example, the inventors have determined that cutters used on the current cutting head suffer from a so called "tracking" problem. That is, the buttons on a following cutter tend to follow the grooves formed in a rock face by the cutter immediately preceding it rather than cutting their own new grooves. The consequence of this is that the number of load cycles required to remove a given amount of rock is significantly higher than it should be. Furthermore since there are a high number of load cycles this tends to fatigue and wear the cutters more than is necessary.

Accordingly it is desirable to provide a solution to the tracking problem. It is also desirable to provide a solution to the tracking problem that has a relatively low cost and that is easy to manufacture and assemble.

SUMMARY OF THE INVENTION

It is an objective of the present invention to provide cutting apparatus suitable to form tunnels and subterranean roadways being specifically configured to cut hard rock, say beyond 120 MPa, in a controlled and reliable manner, that is, apparatus capable of mine development work. It is a further objective to provide a cutting apparatus capable of creating a tunnel with a variable cross sectional area within a maximum and a minimum cutting range. It is a further objective to provide cutting (excavator) apparatus operable in an 'undercutting' mode according to a two stage cutting action. It is a further objective to provide a cutter that has an optimised cutting geometry for the cutting apparatus. It is a further object to provide a cutter that has an optimised geometry for balancing cutter strength and reducing cutter wear.

At least some of the objectives are achieved by providing a cutting head including a plurality of different types of cutter units. The cutter units are distributed circumferentially around a perimeter of each head so as to create a groove or channel into the rock face as the heads are driven about their respective rotational axes. Each cutter includes a disc body and an arrangement of hard buttons for abrading the rock. The different types of cutters are arranged on the cutting head in a manner that addresses the tracking problem. At least some of the objectives can be achieved by mounting cutting units on the cutting head body such that, in the direction of rotation of the cutting head, each immediate successive cutter has a different arrangement of buttons from the arrangement of buttons from its immediate preceding cutter.

At least some of the objectives are achieved by providing a cutting apparatus having a plurality of cutting assemblies, each including a rotatably mounted cutting head that is attached to a support structure by a mounting assembly. Each mounting assembly is arranged to enable its respective cutting head to be pivoted in an upward and downward direction and a lateral side-to-side direction, with respect to the support structure. In particular, each mounting assembly comprises a support pivotally mounted to the support structure and carrying an arm via a respective additional pivot mounting such that each cutting head is capable of pivoting about two pivoting axes. The desired range of movement of each head is provided as the dual pivoting axes are aligned transverse (including perpendicular) to one another and are spaced apart in the longitudinal direction of the apparatus between a forward and rearward end. The heads may then be raised vertically so as to overcome the relatively low tensile strength of the overhanging rock to provide breakage via force and energy that is appreciably lower than a more common compressive cutting action provided by cutting picks and the like.

According to a first preferred embodiment of the invention there is provided a cutting head for a cutting apparatus suitable for creating tunnels or subterranean roadways and the like. The cutting head having: a rotatable cutting head body; a plurality of cutting units mounted on the cutting head body, said cutting units including at least first and second different types of cutting units, the first type of cutting unit having a first rotatable cutter comprising a first disc body and a first arrangement of buttons for abrading rock, said first buttons are mounted in a radially peripheral portion of the disc body and protrude outwardly therefrom, and the second type of cutting unit having a second rotatable cutter comprising a second disc body and a second arrangement of buttons for abrading rock, said second buttons are mounted in a radially peripheral portion of the disc body and protrude outwardly therefrom; wherein the different types of cutting units are different from one another by at least the arrangements of their buttons.

The arrangements of buttons can differ, for example by means of the characteristics of the buttons, such as the size and shape of the buttons, and/or the way in which the buttons are mounted on the disc body, such as the number of buttons, the distribution of buttons on the body, and the mounting orientation of buttons.

The invention significantly mitigates the "tracking" problem and helps to ensure that the majority, of buttons of each subsequent cutter, in the direction of cutting, do not follow the grooves cut into the rock by the respective preceding cutters. Instead the majority, of the buttons of the subsequent cutter abrade new rock and follow different paths across the rock face than the buttons of the preceding cutter in the direction of cutting. This occurs since each subsequent cutter, in the cutting direction, has a different arrangement of cutting buttons from its respective preceding cutter. This has the effect of reducing the number of load cycles required to remove the same amount of rock as a prior art device having only one type of cutter, and reduces fatigue and wear of the cutters. The effect can be achieved by having at least two different types of cutter. The majority of the benefit of the invention can be achieved by having just two different types of cutter. However it will be appreciated that the invention can comprise three or more different types of cutter. Having a low number of different types of cutter (for example two or three different types) simplifies the manufacturing and assembly processes, and reduces cost.

In preferred embodiments the cutting units are mounted on the cutting head body such that, in the direction of rotation of the cutting head, each immediate successive cutter has a different arrangement of buttons from the arrangement of buttons from its immediate preceding cutter. That is, for a given cutter, the cutter immediately preceding it is a different type of cutter from the given cutter. For example, a cutter of type B can be immediately preceded by a cutter of type A. The cutter immediately following the given cutter is a different type of cutter from the given cutter. For example, a cutter of type A can be followed by a cutter of type B. This helps to ensure that the buttons on a following cutter does not track the groves formed by the immediately preceding cutter.

In preferred embodiments the cutting units are mounted on the cutting head body sequentially such that the cutting units alternate in the direction of rotation of the cutting head. For example in the following arrangement A, B, A, B; or A, B, C, A, B, C. This provides a simple and easy to manufacture arrangement that only requires two or more different types of cutting units to address the tracking problem.

In preferred embodiments the cutting head includes at least three cutting units of the first type of cutting unit. In preferred embodiments the cutting head includes at least three cutting units of the second type of cutting unit. Typically, a cutting head includes at least four cutting units. Typically, a cutting head includes less than or equal to 20 cutting units. A particularly preferred embodiment includes 12 cutting units: six of the first type and six of the second type.

In preferred embodiments each first cutter includes a different number of buttons from the number of buttons included in each second cutter. This provides a simple way of addressing the tracking problem. Typically an odd number of buttons is included in each cutter. Each first cutter includes n buttons, each second cutter includes m buttons, wherein $n \neq m$. For example, in one embodiment each first cutter includes 39 buttons and each second cutter includes 45 buttons. Preferably the difference between n and m is at least three buttons, and more preferably at least 5 buttons. In some embodiments a prime number of buttons can be selected for each cutter.

In preferred embodiments the spacing between adjacent buttons on each first cutter is different from the spacing between adjacent buttons on each second cutter. This provides a simple way of addressing the tracking problem. In preferred embodiments the buttons on each first cutter are substantially evenly spaced about the peripheral portion of their respective disc bodies. Therefore the spacing between adjacent buttons is substantially equal. In preferred embodiments the buttons on each second cutter are substantially evenly spaced about the peripheral portion of their respective disc bodies. Therefore the spacing between adjacent buttons is substantially equal. Cutters having this arrangement are easy to manufacture. Of course, the spacing between adjacent buttons on at least one of the first and second cutters can vary around the periphery of the disc. If varying spaces are used, each first cutter has a different pattern of varying spaces from the pattern of varying spaces used on each second cutter.

In preferred embodiments at least some, and preferably each, of the buttons on each first cutter have a different shape from the shape of at least some, and preferably each, of the buttons on each second cutter. In particular, the parts of the first cutter buttons that engage the rock face can be differently shaped from the parts of the second cutter buttons that engage the rock face. For example, one of the first and second buttons can have a rounded conical engagement part and the other of the first and second buttons can have a chiselled or pointed engagement part.

In preferred embodiments at least some, and preferably each, of the buttons on each first cutter have a different size from the size of at least some, and preferably each, of the buttons on each second cutter. For example, the parts of the first cutter buttons that engage the rock face can have a different height, width, length and/or volume than the height, width, length and/or volume of the parts of the second cutter buttons that engage the rock face.

In preferred embodiments each cutting unit includes a rotatable shaft having a central longitudinal axis and the cutter is mounted on the shaft. At least some, and preferably each, of the first buttons each have a central longitudinal axis that subtends an angle $\alpha_A$ with respect to a reference line that extends perpendicularly from the central longitudinal axis of the shaft. At least some, and preferably each, of the second buttons each have a central longitudinal axis that subtends an angle $\alpha_B$ with respect to a reference line that extends perpendicularly from the central longitudinal axis of the shaft. Preferably $\alpha_A$ is different from $\alpha_B$.

Preferred embodiments include at least one further type of cutting unit. The at least one further type of cutting unit can include a further rotatable cutter comprising a further disc body and a further arrangement of buttons for abrading rock. The further buttons are mounted in a radially peripheral portion of the further disc body and protrude outwardly therefrom. The further arrangement of buttons is different from the first and second arrangements of buttons.

In preferred embodiments the cutting units are mounted to a radially peripheral part of the cutting head body.

In preferred embodiments the cutting units are distributed around a pitch circle on the cutting head body. Preferably the central longitudinal axis of each cutting unit rotatable shaft is positioned on the pitch circle.

In preferred embodiments the cutting head body is annular.

In preferred embodiments the cutting head body has a central axis arranged substantially perpendicularly to the plane of the body. Each disc body has a central axis that is arranged substantially perpendicular to the plane of its respective disc body. The central axes of the disc bodies are arranged substantially parallel with the central axis of the cutting head body. Thus the plane of each disc body is approximately parallel with the plane of the cutting head body.

In preferred embodiments each cutter is freely rotatable relative to the cutting head. That is, each cutter is not directly driven. Each cutter rotates in reaction to engagement with the rock face.

According to another preferred embodiment of the invention there is provided cutting apparatus suitable for creating tunnels or subterranean roadways and the like. The apparatus includes: a support structure having generally upward, downward, frontward and side facing regions; first and second cutting assemblies, each of the first and second cutting assemblies including a cutting head according to any configuration described herein and a mounting assembly. The mounting assembly attaches the cutting head to the support structure in a manner that enables the cutting head to move with respect to the support structure. The mounting assembly includes a first pivot axis wherein the cutting head is movable about the first pivot axis thereby enabling the cutting head to move in a generally sideways direction relative to support structure. The mounting assembly includes a second pivot axis wherein the cutting head is movable about the second pivot axis thereby enabling the cutting head to move in a generally upwards-downwards direction relative to the support structure.

In preferred embodiments the cutting units provide an undercutting mode of operation.

In preferred embodiments each mounting assembly includes: a support pivotally mounted relative to the support structure via a the first pivot axis, which is aligned generally upright relative to the upward and downward facing regions such that each support is configured to pivot laterally in a sideways direction relative to the side facing regions; at least one support actuator to actuate independent movement of each of the supports relative to the support structure; an arm assembly pivotally mounted to the support via the second pivot axis aligned in a direction extending transverse including perpendicular to each support pivot axis to enable the arm to pivot independently relative to the support in an upward and downward direction relative to the upward and downward facing regions; at least one arm actuator actuate independent pivoting movement of the arm relative to the support; wherein each rotatable cutting head is mounted towards a free end of its respective arm, and each cutting head is rotatable about a head axis orientated to extend substantially transverse to each arm pivot axis.

In preferred embodiments each arm actuator comprises a planetary gear assembly mounted at the junction at which each arm pivots relative to each support.

In preferred embodiments each arm actuator includes at least one first drive motor to drive the pivoting movement of the arm relative to the support.

In preferred embodiments each support actuator comprises a hydraulic linear actuator.

In preferred embodiments each cutting assembly includes at least one second drive motor to drive rotation of the cutting head relative to the arm.

In preferred embodiments the support structure includes a main frame and a powered sled movably mounted at the main frame to be configured to slide in a forward cutting direction of the apparatus relative to the main frame, and each cutting head is mounted at the sled via its respective arm and support so as to be configured to advance in the forward cutting direction.

In preferred embodiments each arm is configured to pivot in the upward and downward direction by up to 180°; and each support is configured to pivot in the lateral sideways direction by up to 90°. Optionally, each arm may be configured to pivot over a range of up to 155°. Optionally, the first and second supports are configured to pivot in the lateral sideways direction by up to 90°. Optionally, the supports may be configured to pivot up to 20° in the lateral sideways direction. Such a configuration provides control of the profile shape and avoids any cuts or ridge that would otherwise remain on the roof and floor of the as-formed tunnel.

Preferably, the apparatus comprises tracks or wheels mounted at the main frame to allow the apparatus to move in a forward and rearward direction. The tracks or wheels enable the apparatus to be advanced forwardly and rearwardly within the tunnel both when maneuvered into and from the cutting face between cutting operations and to be advanced forwardly during cutting operations as part of the cut-and-advance cutting cycle that also utilises the sliding sled.

Preferably, the apparatus further comprises floor and roof engaging members mounted at the main frame, at least the floor engaging members being extendable and retractable to respectively raise and lower the apparatus in the upward and downward direction. The engaging members are configured to wedge the apparatus in position between the roof and floor of the tunnel to provide points of anchorage against which the machine may be braced to allow the cutters to be forced against the rock face.

Preferably, the apparatus further comprises a first material discharge conveyor to convey cut material rearwardly from the first and second cutting head; and a gathering head to direct cut material onto the conveyor, the gathering head positioned rearwardly behind at least one of the first and second cutting heads. The apparatus is accordingly configured to transport rearwardly material from the cut face to provide unhindered forward cutting movement into the rock.

Preferably, the apparatus further comprises a control unit demountably connectable to the apparatus, the control unit comprising operational components to power at least the first and second support and arm actuators, the control unit further comprising a second conveyor to receive material from the first conveyor and to discharge the material at a position rearward of the apparatus and the control unit. Preferably, the control unit is demountably coupled to the apparatus so as to be capable of being advanced and refracted in the forward and rearward directions with the cutting apparatus. Preferably, the control unit is suspended above the tunnel floor by suitable couplings to the apparatus. The control unit may comprise ground engaging support members provided at a rearward and/or forward regions. Optionally, the control unit may be attachable at its rearward end to a material collection and discharge vehicle and to be connectable at its forward end to the cutting apparatus.

According to another preferred embodiment of the invention there is provided cutting apparatus suitable for creating tunnels or subterranean roadways and the like, the cutting apparatus including: a main frame having generally upward, downward and side facing regions; a powered sled movably mounted at the main frame and configured to slide in a forward cutting direction of the apparatus relative to the main frame; first and second arms pivotally mounted to the sled by respective pivot arm axes aligned in a direction extending transverse including perpendicular to a longitudinal axis of the main frame to allow each arm to pivot independently of one another in an upward and downward direction relative to the upward and downward facing region of the main frame; at least one first and second arm actuator to actuate independent pivoting movement of the first and second arms relative to one another and the main frame; each of the first and second arms having a cutting head according to any configuration described herein, each cutting head is moveable in the upward and downward direction and can be advanced in the forward cutting direction, each cutting head being rotatable about a head axis orientated to extend substantially transverse to respective pivot arm axes.

Optionally, each of the first and second arms is respectively mounted at a first and second support slidably mounted relative to the main frame via a common or respective slidable means such that each first and second support is configured to slide laterally in a sideways direction relative to the side facing regions.

Optionally, each rotatable cutting head comprises a generally annular roller cutter each having a generally annular cutting edge or layered cutting edges to provide an undercutting mode of operation.

In preferred embodiments each of the roller cutters is independently rotatably to its respective cutting head.

Optionally, the plurality of roller cutters are generally annular roller cutters each having a generally annular cutting edge or layered cutting edges to provide an undercutting mode of operation.

Optionally, each of the first and second arm actuator comprises a planetary gear assembly mounted at the junction at which each arm pivots relative to each support.

According to another preferred embodiment of the invention there is provided a cutting head for cutting apparatus suitable for creating tunnels or subterranean roadways and the like, said cutting head having: a rotatable cutting head body; a first set of a first type of cutting unit mounted on the cutting head body, each first type of cutting unit having a first rotatable cutter comprising a first disc body and a first arrangement of buttons for abrading rock, said buttons are mounted in a radially peripheral portion of the disc body and protrude outwardly therefrom; and a second set of a second type of cutting unit mounted on the cutting head body, each second type of cutting unit having a second rotatable cutter comprising a second disc body and a second arrangement of buttons for abrading rock, said buttons are mounted in a radially peripheral portion of the disc body and protrude outwardly therefrom; wherein said second arrangement of buttons is different from the first arrangement of buttons, and the cutting units are mounted on the cutting head body sequentially such that the first and second types of cutting units alternate in the direction of rotation of the cutting head.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
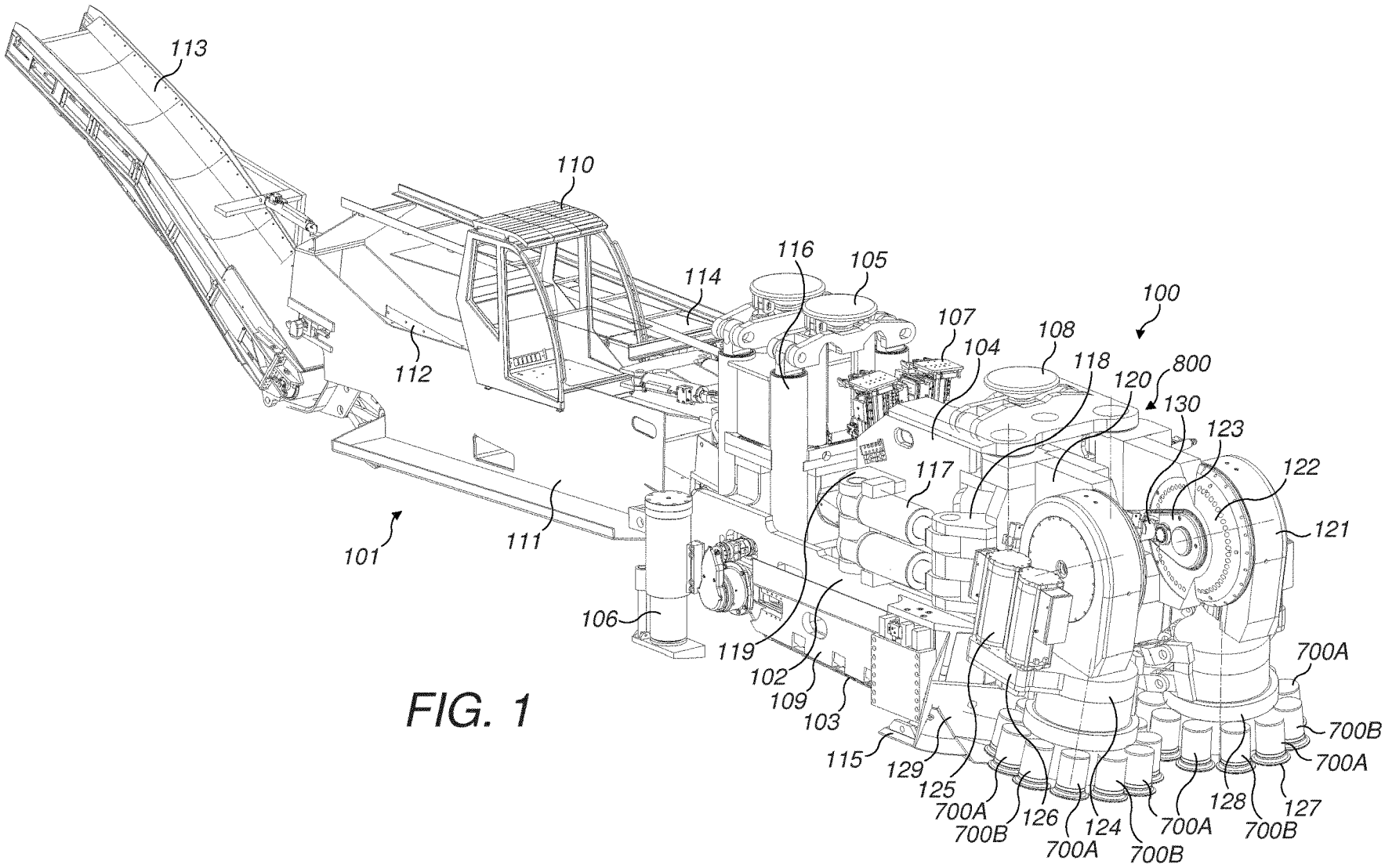
FIG. 1 is a front isometric view of a mobile cutting apparatus suitable for creating tunnels or subterranean roadways having a forward mounted cutting unit and a rearward control unit according to a first embodiment of the present invention.

Referring to FIG. 1, cutting apparatus 100 comprises a support structure 800 mounting a plurality of cutting components configured to cut into a rock or mineral face 1000 to create tunnels or subterranean roadways. Apparatus 100 is configured specifically for operation in an undercutting mode in which a plurality of rotatable roller cutters 127A, 127B may be forced into the rock to create a groove or channel and then to be pivoted vertically upward so as to overcome the reduced tensile force immediately above the groove or channel and break the rock. Accordingly, the present cutting apparatus is optimised for forward advancement into the rock or mineral utilising less force and energy typically required for conventional compression type cutters that utilise cutting bits or picks mounted at rotatable heads. However, the present apparatus may be configured with different types of cutting head to those described herein including in particular pick or bit type cutting heads in which each pick is angularly orientated at the cutting head to provide a predetermined cutting attack angle.

Figure 2:
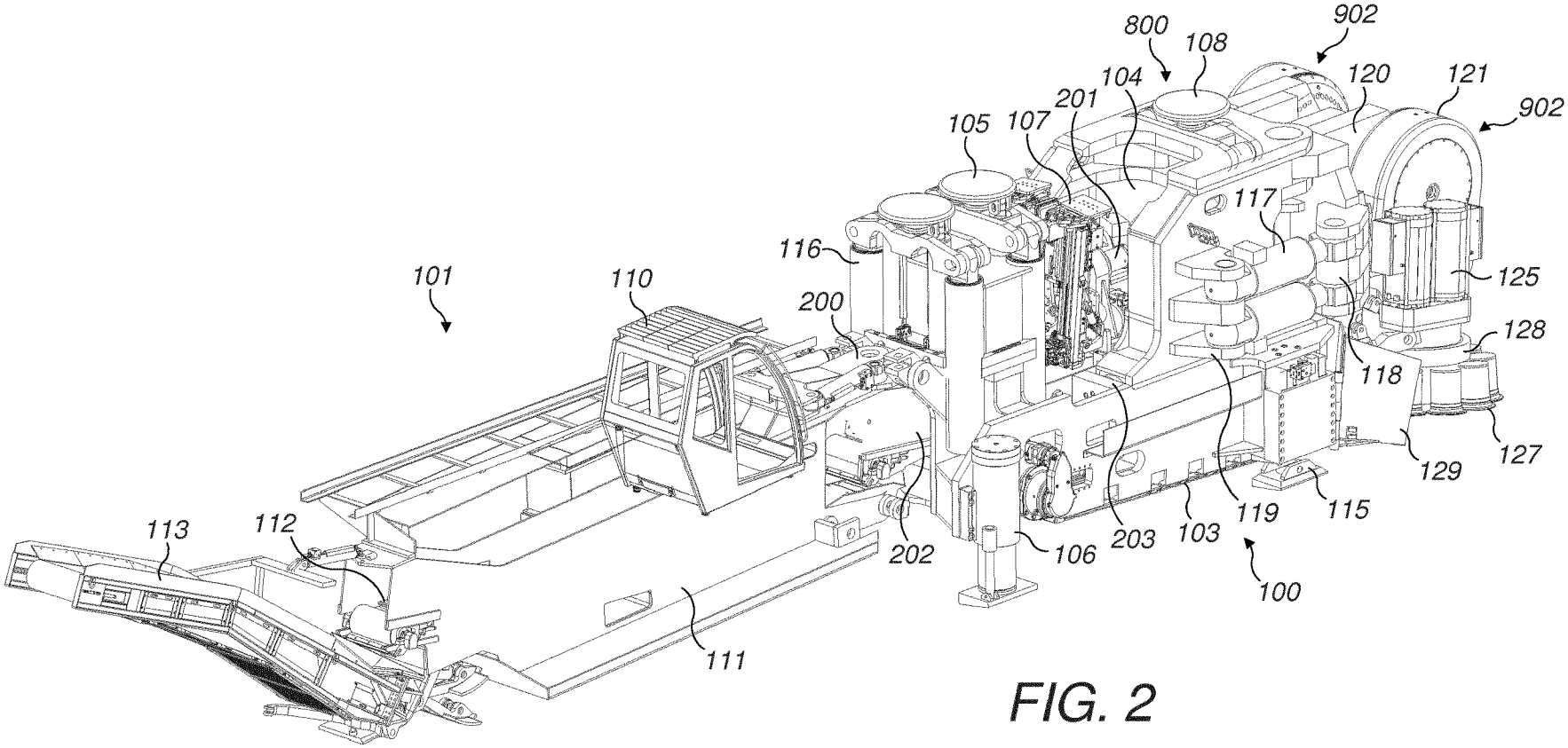
FIG. 2 is a rear isometric view of the cutting apparatus of FIG. 1.
Figure 3:
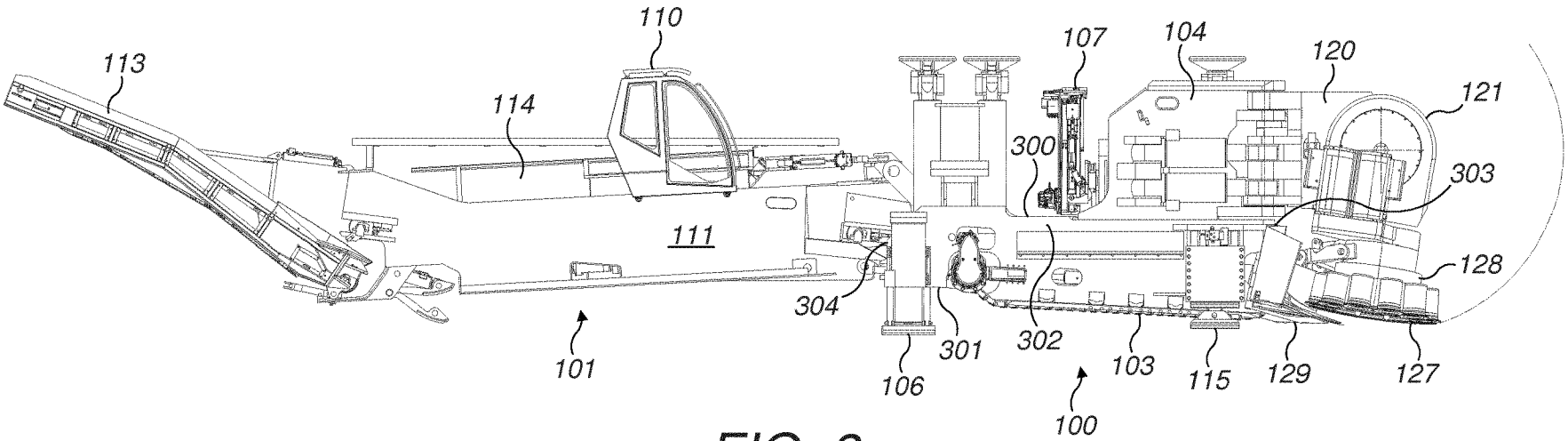
FIG. 3 is a side elevation view of the apparatus of FIG. 2.

Referring to FIGS. 1 to 3, the support structure 800 includes a main frame 102. The main frame 102 comprises lateral sides 302 to be orientated towards the wall of the tunnel; an upward facing region 300 to be orientated towards a roof of the tunnel; a downward facing region 301 orientated to be facing the floor of the tunnel; a forward facing end 303 intended to be positioned facing the cutting face and a rearward facing end 304 intended to be positioned facing away from the cutting face.

An undercarriage 109 is mounted generally below main frame 102 and in turn mounts a pair of crawler tracks 103 driven by a hydraulic (or electric) motor to provide forward and rearward movement of apparatus 100 over the ground when in a non-cutting mode. A pair of rear ground engaging jacking legs 106 are mounted at frame sides 302 towards rearward end 304 and are configured to extend and retract linearly relative to frame 102. Frame 102 further comprises a forward pair of jacking legs 115 also mounted at each frame side 302 and towards forward end 303 and being configured to extend and retract to engage the floor tunnel. By actuation of legs 106, 115, main frame 102 and in particular tracks 103 may be raised and lowered in the upward and downward direction so as to suspend tracks 103 off the ground to position apparatus 100 in a cutting mode. A pair of roof engaging grippers 105 project upwardly from main frame 102 at frame rearward end 304 and are extendable and retractable linearly in the upward and downward direction via control cylinders 116. Grippers 105 are therefore configured to be raised into contact with the tunnel roof and in extendable combination with jacking legs 106, 115 are configured to wedge apparatus 100 in a stationary position between the tunnel floor and roof when in the cutting mode.

The support structure 800 includes a sled 104. The sled 104 is slidably mounted on top of main frame 102 via a slide mechanism 203. Sled 104 is coupled to a linear hydraulic cylinder 201 such that by reciprocating extension and retraction of cylinder 201, sled 104 is configured slide linearly between frame forward and rearward ends 303, 304.

A pair of hydraulically actuated bolting units 107 are mounted at main frame 102 between sled 104 and roof gripping unit 105, 116 relative to a lengthwise direction of the apparatus. Bolting units 107 are configured to secure a mesh structure (not shown) to the roof of the tunnel as apparatus 100 is advanced in a forward cutting direction. Apparatus 100 also comprises a mesh support structure (not shown) mounted generally above sled 104 so as to positionally support the mesh directly below the roof prior to bolting into position.

Figure 4:
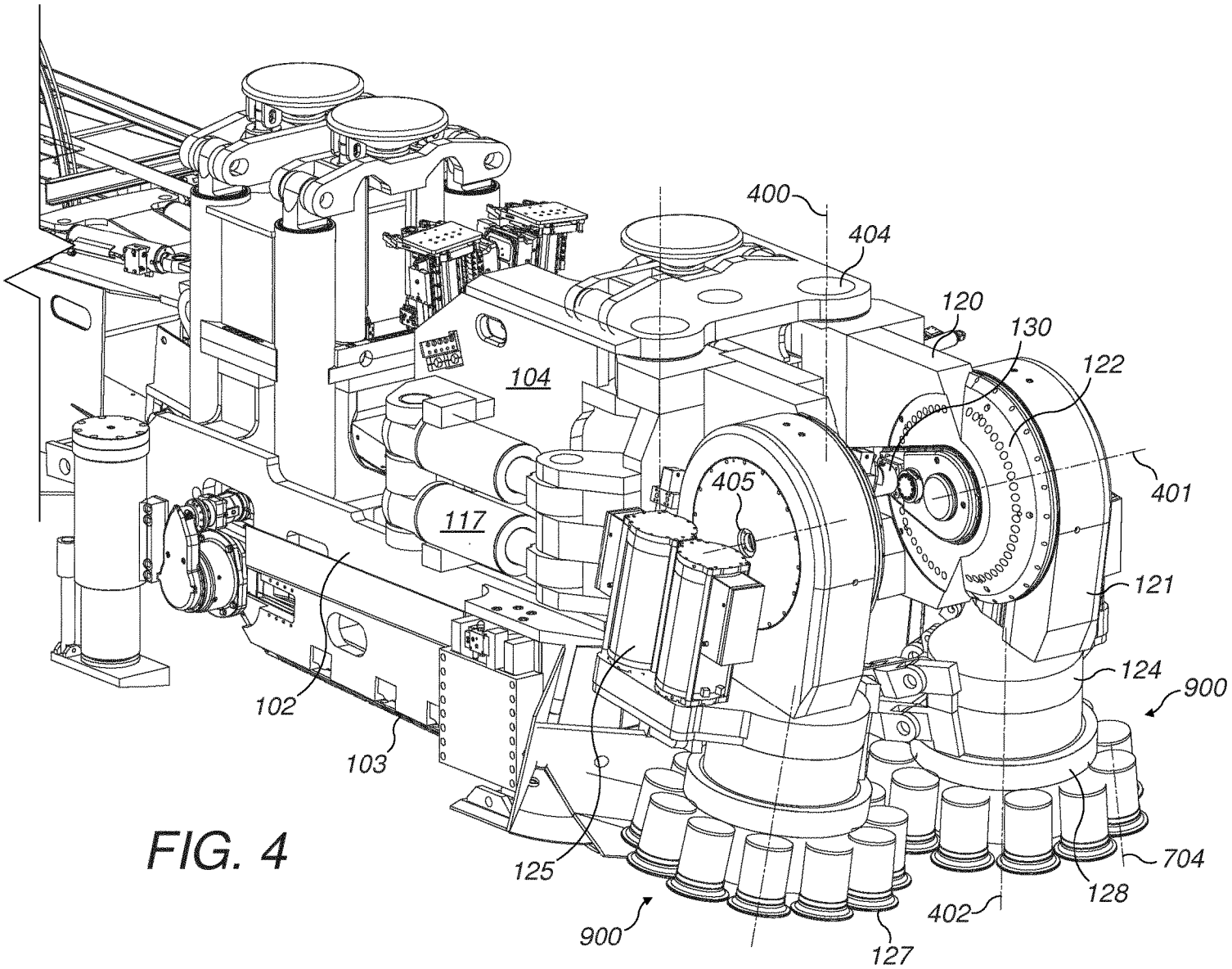
FIG. 4 is a magnified front isometric view of the cutting unit of the apparatus of FIG. 3.
Figure 5:
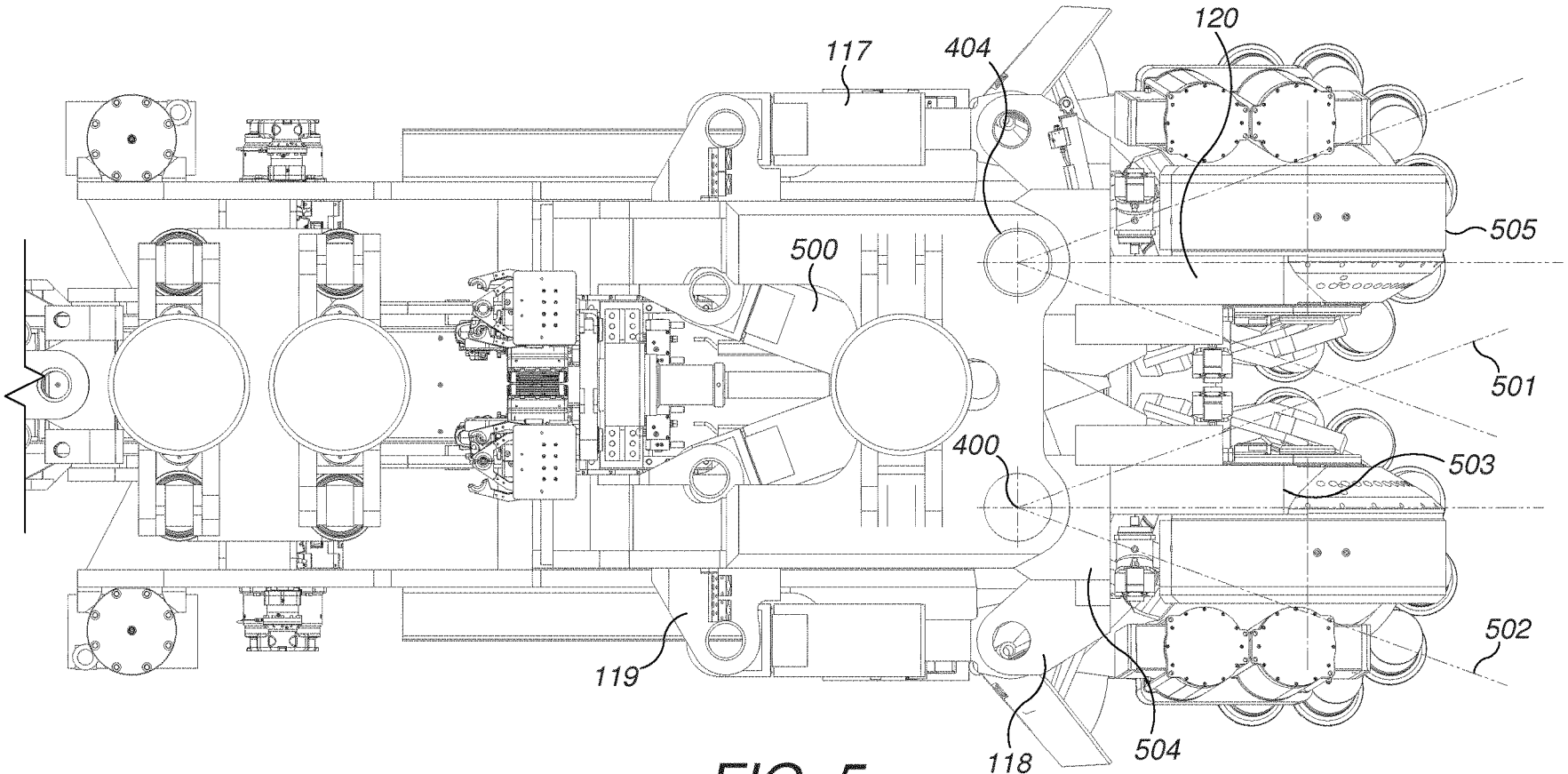
FIG. 5 is a plan view of the cutting apparatus of FIG. 4.

The cutting apparatus 100 includes first and second cutting assemblies 900 (see FIGS. 4 and 2). The first cutting assembly 900 includes a first cutting head 128 and a first mounting assembly 902. The second cutting assembly 902 includes a second cutting head 128 and a second mounting assembly 902. Each mounting assembly 902 includes a support 120. Each support 120 is pivotally mounted at, and project forwardly from, sled 104 immediately above frame forward end 303. Supports 120 are generally spaced apart in a lateral widthwise direction of the apparatus 100 and are configured to independently pivot laterally outward from one another relative to sled 104 and main frame 102. Each support 120 comprises a forward end 503 and a rearward end 504 referring to FIG. 5. A first mount flange 118 is provided at support rearward end 504 being generally rearward facing. A corresponding second mount flange 119 projects laterally outward from a side of sled 104 immediately behind the first flange 118. A pair of linear hydraulic cylinders 117 are mounted to extend between flanges 118, 119 such that by linear extension and retraction, each support 120 is configured to pivot in the generally horizontal plane and in the lateral sideways direction relative to frame sides 302. Referring to FIG. 4, each support 120 is mounted at sled 104 via a pivot rod 404 extending generally vertically (when apparatus 100 is positioned on horizontal ground) through sled 104 and being suspended generally above the main frame forward end 303. Each support 120 is therefore configured to pivot or slew about pivot axis 400. Referring to FIG. 5, each support 120 is further coupled to a respective inner hydraulic cylinder 500 mounted at an inner region of sled 104 to cooperate with side mounted cylinders 117 to laterally slew each support 120 about pivot axis 400.

Referring to FIGS. 4 and 5, as the respective pivot axes 400 are space apart in the widthwise direction of apparatus 100, supports 120 are capable of being slewed inwardly to a maximum inward position 501 and to be slewed laterally outward to a maximum outward position 502. According to the specific implementation, an angle between the inner and outer slewing positions 501, 502 is 20°.

Referring to FIGS. 1 to 3, each mounting assembly 902 includes an arm 121. Each arm is pivotally mounted generally at the forward end 503 of each support 120. Each cutting head 128 is rotatably mounted at a free distal end of each arm 121. Each cutting head 128 comprises a disk like (generally cylindrical) configuration.

Figure 7:
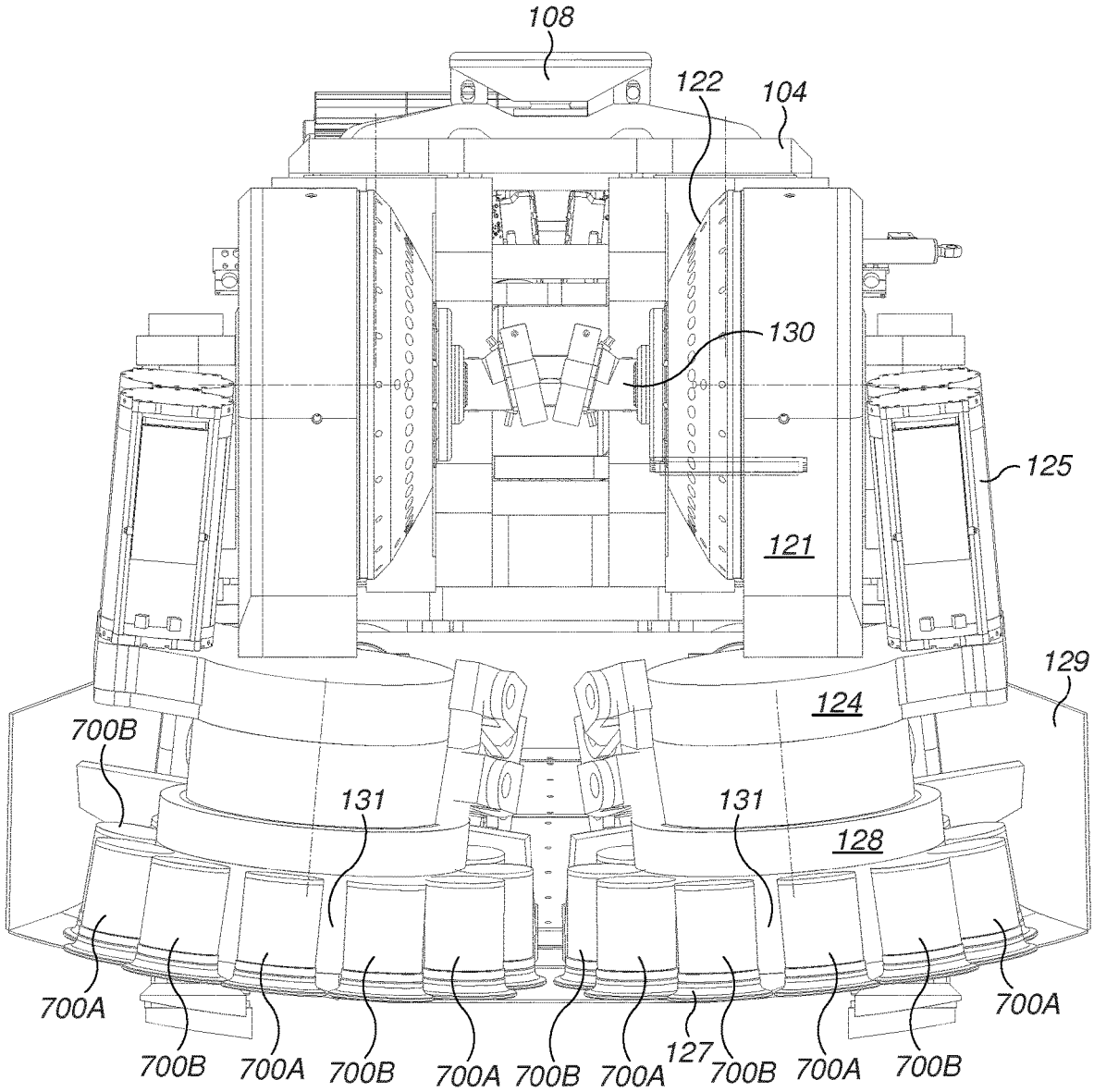
FIG. 7 is a front end view of the cutting apparatus of FIG. 6.
Figure 8:
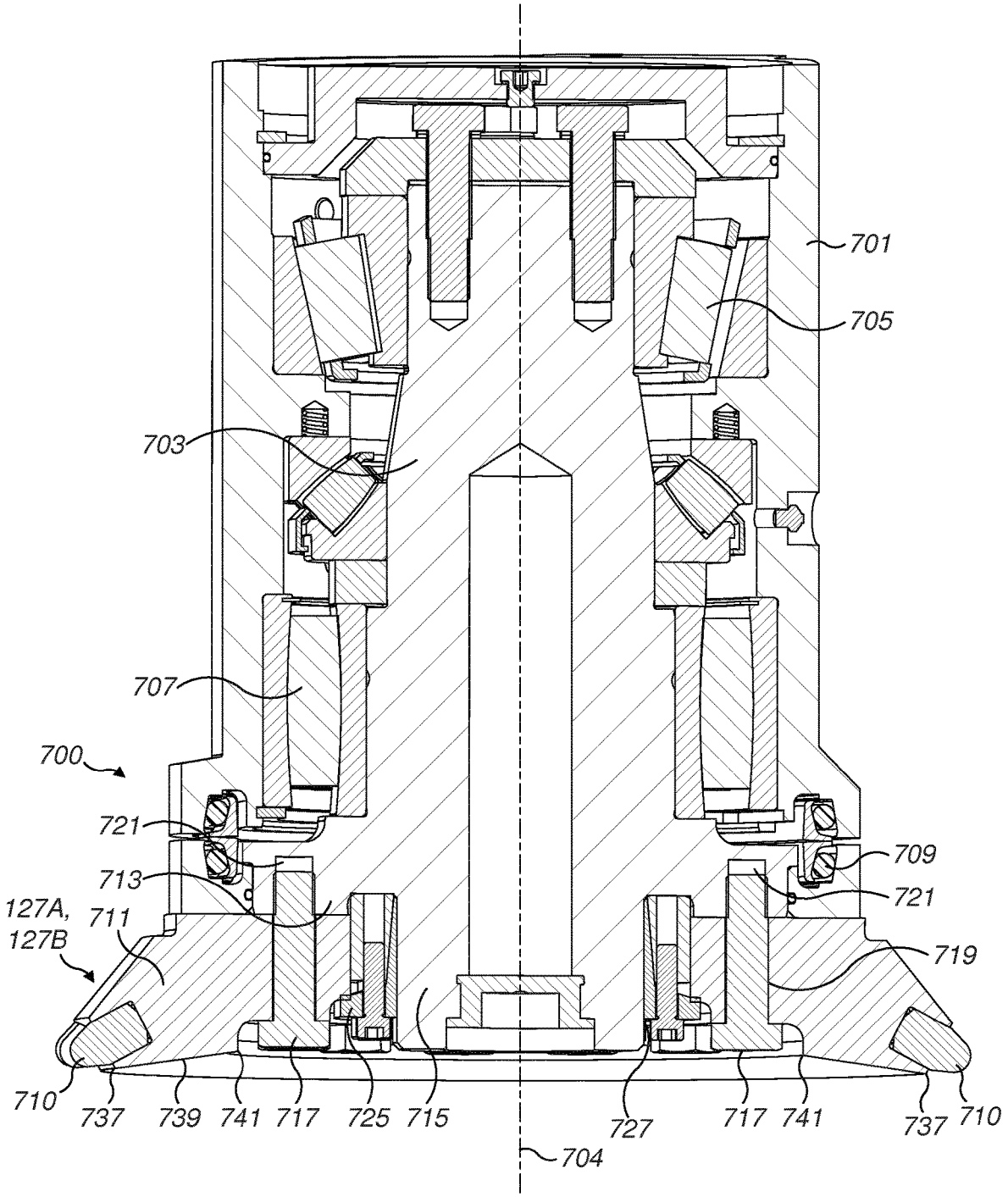
FIG. 8 is a longitudinal cross-sectional view of a cutting unit, including a cutter for abrading rock.

Each cutting head 128 includes a body 131 and 12 cutting units: six of a first type of cutting unit 700A and six of a second type of cutting unit 700B (see FIGS. 1 and 7). Details of the cutting units 700 are best seen in FIGS. 8 to 11. Each cutting unit 700A, 700B includes a casing 701, a shaft 703, a first bearing 705, a second bearing 707, and a third bearing 709. Each first type of cutting unit 700A includes a first cutter 127A comprising a first disc body 711A and a first arrangement of buttons 710A. Each second type of cutting unit 700 includes a second cutter 127B comprising a second disc body 711 and a second arrangement of buttons 710B.

Preferably the shaft 703, bearings 705, 707, 709 and casing 701 are similar for both types of cutting unit 700A, 700B. Thus the following description is applicable to both types of cutting units 700A, 700B, unless indicated otherwise. The shaft 703 has a central longitudinal axis 704, and since each disc body 711A, 711B is mounted on its respective shaft 703, the disc body 711A, 711B shares this axis. The central axis 704 is arranged substantially perpendicular to the plane of the disc. The shaft 703 is journalled in the first, second and third bearings 705, 707, 709 and is arranged to rotate freely in the bearings. The shaft 703 includes a flange 713 towards a lower end 715 of the shaft. The disc body 711A, 711B is fixed to the lower end 715 of the shaft, and rotates with the shaft. The disc 711A, 711B is attached to the shaft by bolts 717. The bolts 717 pass through holes 719 formed through the plane of the disc 711A, 711B, and into threaded holes 721 in the flange 713. The disc 711A, 711B is annular. The disc 711A, 711B has a central through hole 723. The disc 711A, 711B is mounted onto the shaft 703 such that the lower end 715 of the shaft protrudes through the central through hole 723. A collar assembly 725 sits in an annular space between an outer surface 727 of the lower end of the shaft and an inner surface 729 of the annular disc.

The disc 711A, 711B includes an upper side 730, an underside 732, and a radially peripheral part 738.

The upper side 730 faces generally towards arms 121, and away from the rock face 1000, during an undercutting operation. The upper side 730 includes an annular upper surface 731, which is substantially planar. The upper surface 731 abuts against the flange 713.

The radially peripheral part 738 generally comprises the outer circumferential edge portion of the disc 711A, 711B. The radially peripheral part 738 includes a first (upper) annular tapering surface 733, which tapers upwardly and inwardly towards the upper surface 731. The first tapering surface 733 has a maximum diameter at its lower edge 734 and a minimum diameter at its upper edge 736. The radially peripheral part 738 includes a second (lower) annular tapering surface 735, which tapers downwardly and inwardly from the lower edge 734 of the first tapering surface, to its own lower edge 737. Thus the second annular tapering surface 735 has a maximum diameter at edge 734 and a minimum diameter at edge 737. The edge 734 is the maximum diameter of the disc 711A, 711B.

The underside 732 faces generally towards the rock face 1000 during an undercutting operation. The underside 732 is recessed to reduce the amount of friction between the disc 711A, 711B and the rock face 1000. It will be appreciated that the recessed underside 732 can take many different forms, for example the recessed underside 732 can have a substantially concave formation. A particularly preferred arrangement is for the underside 732 to include an annular tapering surface 739 which tapers inwardly and upwardly from lower edge 737 to upper edge 741. Thus the annular tapering surface 739 has a maximum diameter at lower edge 737 and a minimum diameter at upper edge 741.

Figure 9:
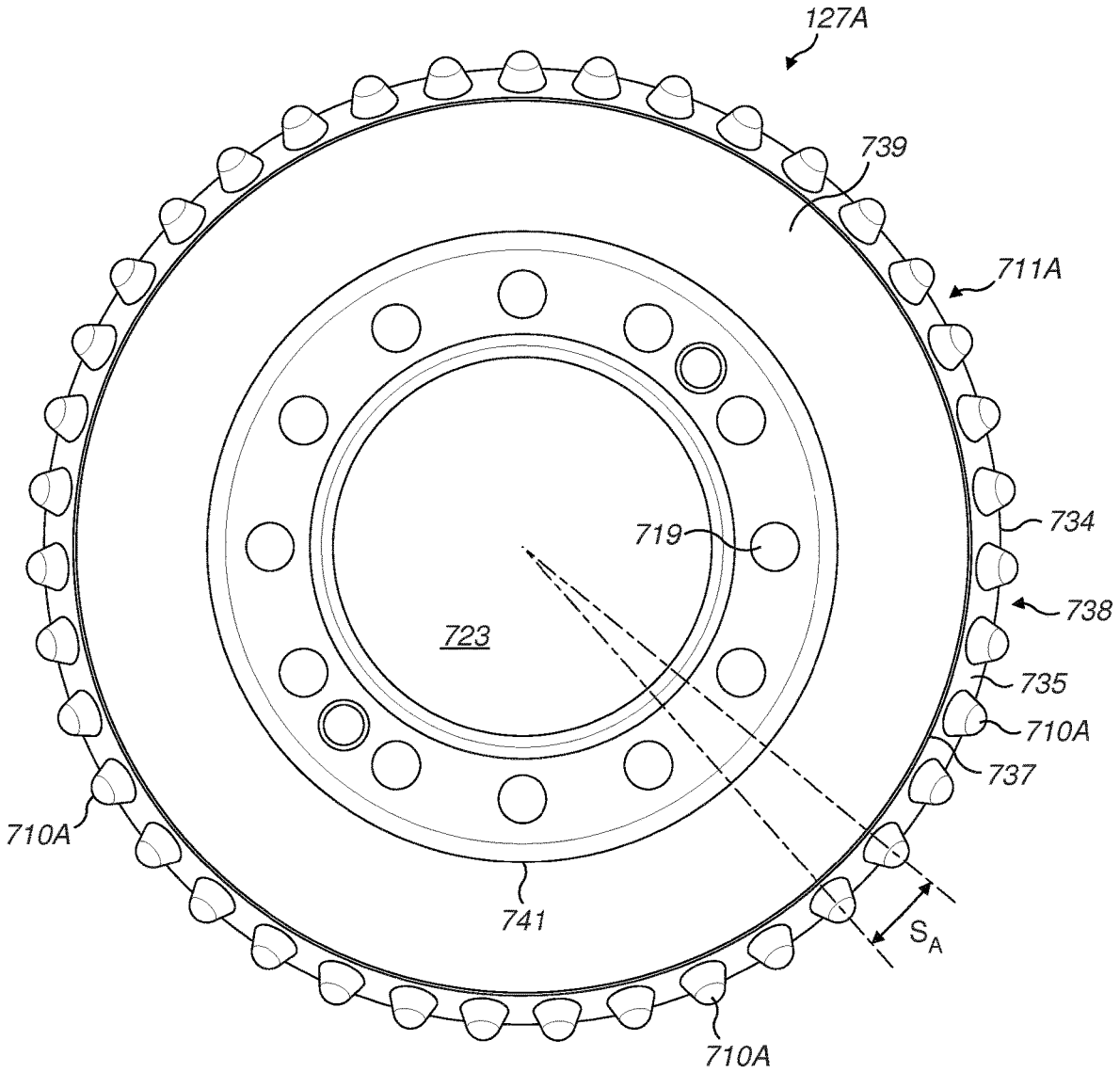
FIG. 9 is a view of an underside of a first cutter (the cutting unit of FIG. 8 including the first cutter is referred to as a first cutting unit)
Figure 10:
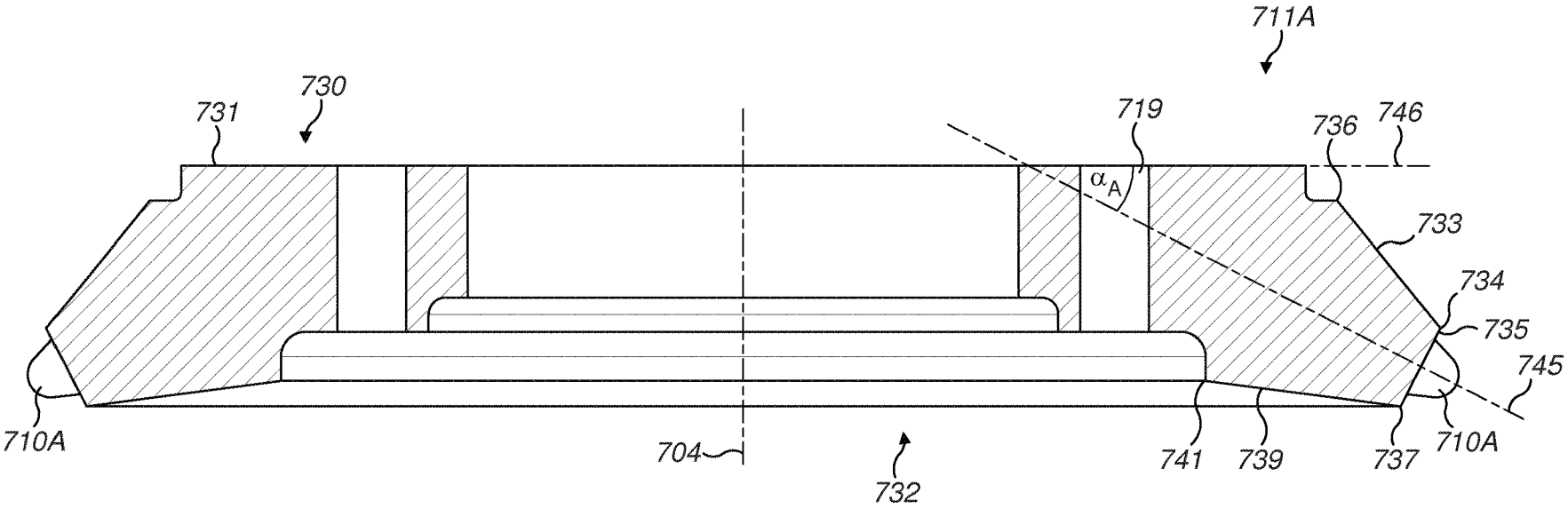
FIG. 10 is a cross-sectional view of the first cutter shown in FIG. 9.
Figure 11:
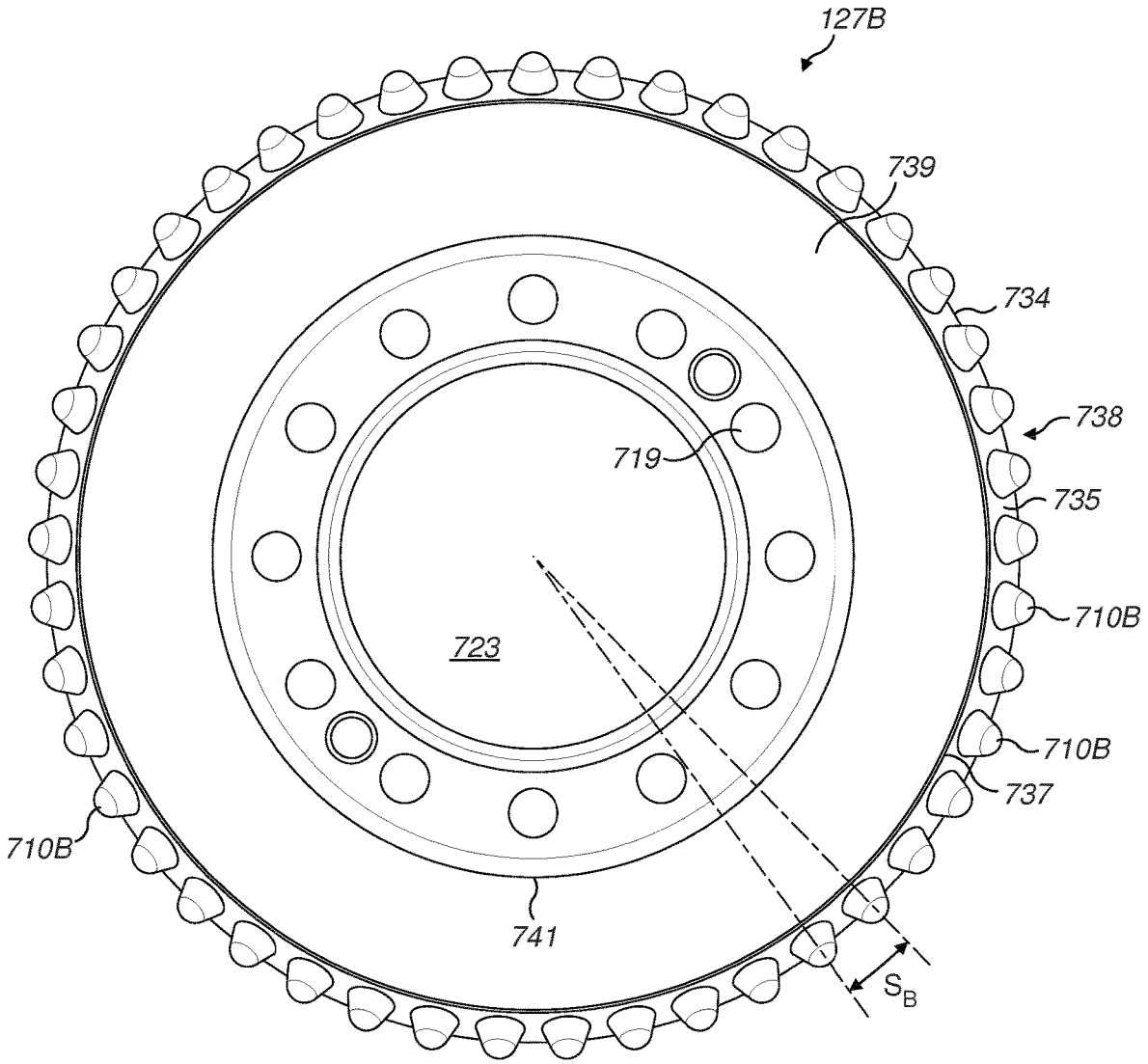
FIG. 11 is a view of an underside of a second cutter (the cutting unit of FIG. 8 including the second cutter is referred to as a second cutting unit)

Many holes 743 are bored into the annular tapering surface 735. In the preferred arrangement of the invention, the number of holes 743 formed in the first disc 711A is different from the number of holes 743 formed in the second disc 711B. Typically around 30 to 60 holes 743 are formed in each disc 711A, 711B. For example, the first disc 711A can include 39 holes formed therein. The second disc 711B can include 45 holes formed therein. A button 710A, 710B is located in each of the holes 743. Therefore, the number of buttons 710A, 710B mounted to the first disc 711A is different from the number of buttons 711B mounted to the second disc 711B. Comparing FIGS. 9 and 11, FIG. 9 shows the first disc 711A having 39 buttons 710A and FIG. 11 shows the second disc 711B having 45 buttons 711B. Preferably an odd number of buttons 710A, 710B is mounted to each disc 711A, 711B, and in some instances a prime number of buttons 710A, 710B is used. Preferably the buttons 710A on each of the first cutters 127A are substantially evenly spaced about the peripheral portion of their respective disc bodies 711A. Preferably the buttons 710B on each of the second cutters 127B are substantially evenly spaced about the peripheral portion of their respective disc bodies 711B. This arrangement is easy to manufacture, and provides a low cost approach to mitigating the tracking problem. Each button 710A, 710B protrudes outwardly from the disc 711A, 711B beyond the maximum radius 734 of the disc. Thus the circumscribed diameter of the cutter 127A, 127B is defined by the extent to which the buttons 710A, 710B protrude beyond the edge of the disc 711A, 711B. The buttons 710A, 710B are made from hard material, such as tungsten carbide, and are arranged abrade rock as the cutting head 128 rotates.

Figure 12:
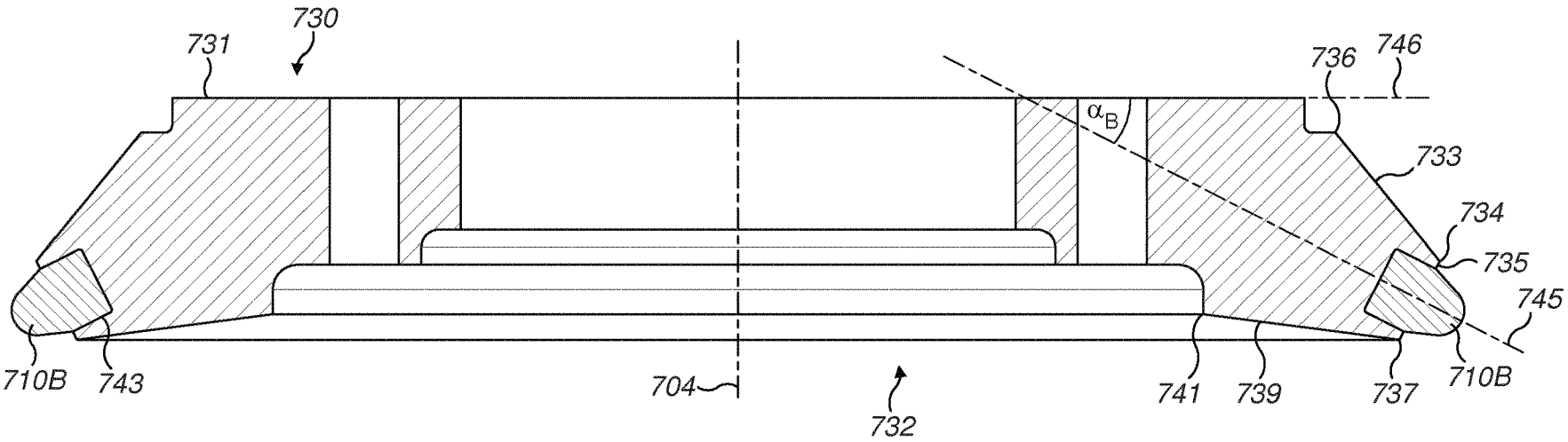
FIG. 12 is a cross-sectional view of the second cutter shown in FIG. 11.

Each button 710A, 710B has a central longitudinal axis 745. The central longitudinal axis of the button 745 subtends an angle $\alpha_A$, $\alpha_B$ with a reference axis 746, which projects perpendicularly outwards from the central longitudinal axis of the shaft 704 (see FIGS. 10 and 12). The reference line 746 is aligned with the plane of the disc body. The angle $\alpha_A$, $\alpha_B$ determines how the resultant cutting force acting on the tool will be split along the button 710 geometry, and perpendicular to it. An $\alpha_A$, $\alpha_B$=0° arrangement would be optimised for a pure shear up cutting movement, however this arrangement would not work well in the sump phase. The inventors have determined that $\alpha_A$, $\alpha_B$ should be larger than zero in order for the machine to operate properly. For at least some buttons 710A, 710B, and preferably each button 710A, 710B, on the disc 711A, 711B $\alpha_A$, $\alpha_B$ is set in the range 20° to 34°, preferably between 24° and 28°, and more preferably still at around 28°. The inventors have determined, after significant testing, that these ranges provide the best overall cutting effect for cutters 127A, 127B for this type of boring machine. In particular, taking into account the range of movement of the cutting heads 128 that is undertaken by this type of rock cutting apparatus.

The size of the cutting disc 711 is selected for the application. A preferred maximum diameter of the disc is typically around 17" (431.8 mm).

Thus the plurality of generally annular or disc shaped roller cutters 127A, 127B are mounted at the circumferential perimeter of each head 128 and comprise a sharp annular cutting edge configured specifically for undercutting the rock. Cutters 127A, 127B are rotatably mounted independently relative to one another, and to the head 128, and are generally free to rotate about their own axis. Each roller cutter 127A, 127B projects axially beyond a forwardmost annular edge of head 128 such that when arms 121 are orientated to be extending generally downward, roller cutters 127A, 127B represent a lowermost part of the entire head 128 and arm 121 assembly.

The cutting units 700A, 700B are mounted on the cutting head body 131 sequentially around a pitch circle in an alternating fashion, that is in the following sequence: A, B, A, B, A, B, A, B, A, B, A, B. It will be apparent that as the cutting head body 131 rotates, each successive cutter will have a different arrangement of buttons from the cutter immediately preceding it. This significantly mitigates the tracking problem. It also provides a solution to the tracking problem that is easy to manufacture since it requires just two different types of cutting unit 700A, 700B, and the different types of cutting units 700A, 700B differ in that theirs cutters 127A, 127B have a different number of buttons 710A, 710B.

Each arm 121 may be considered to comprise a length such that arm 121 is mounted at each respective support 120 at or towards a proximal arm end and to mount each head 128 at a distal arm end. In particular, each arm 121 comprises an internally mounted planetary gear indicated generally be reference 122. Each gear 122 is preferably a Wolfrom type and is coupled to a drive motor 130 via a drive train indicated generally by reference 123. A pair of drive motors 125 are mounted at the lateral sides of each arm 121 and are orientated to be approximately parallel with the rotational axis of each respective cutting head 128 as shown in FIG. 7. Each arm 121 further comprise an internal drive and gear assembly 124 coupled to a gear box 126 mounted at one end of each of the drive motors 125. Each cutting head 128 is driveably coupled to the drive motors 125 via the respective gear assembly 124 to provide rotation of cutting head 128 about axis 402.

Figure 6:
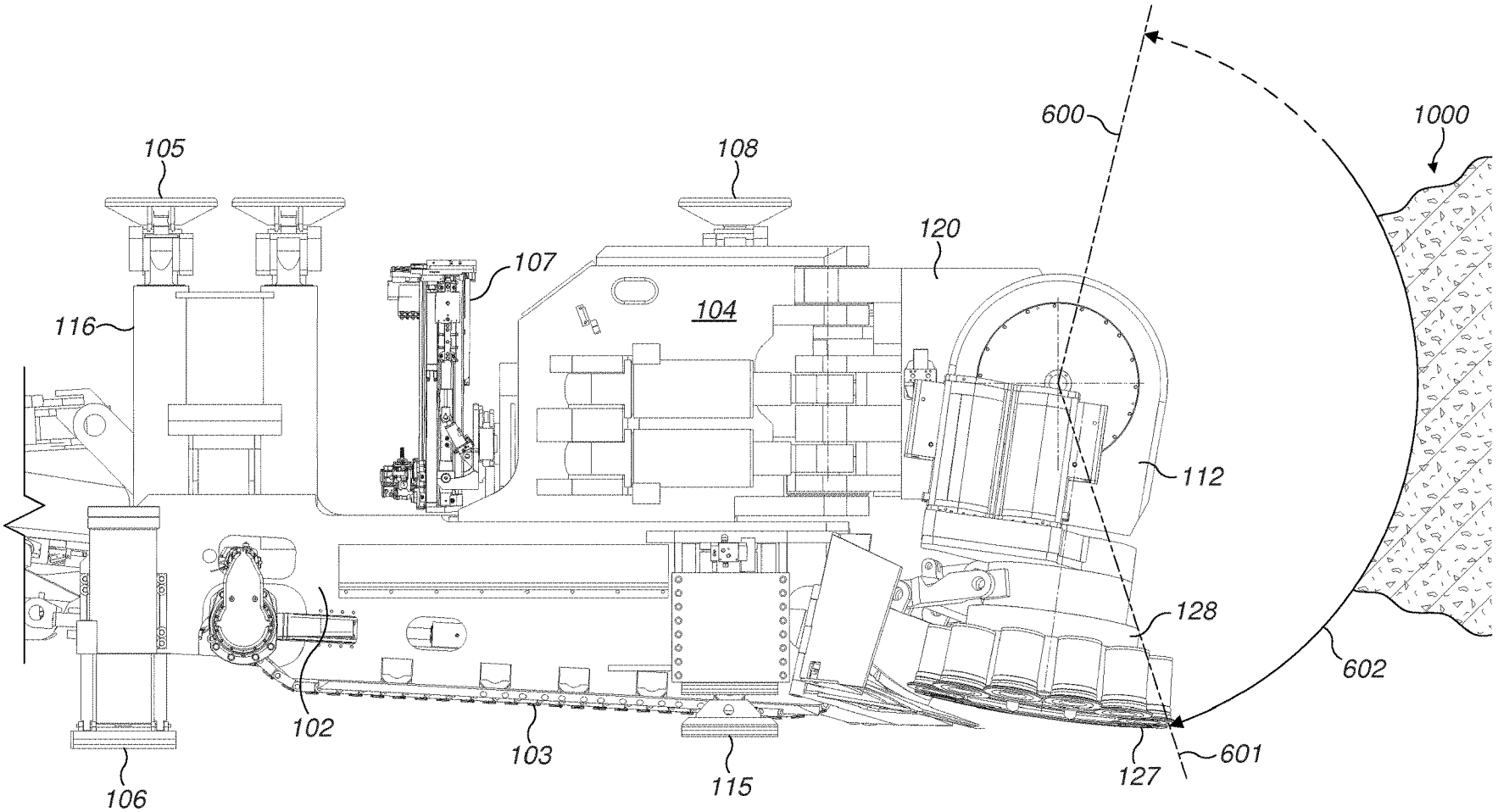
FIG. 6 is a side elevation view of the cutting apparatus of FIG. 5.

As shown in FIG. 7, each arm 121 is coupled to a respective motor 130 mounted at a forward end of sled 104. Each planetary gear 122 is centred on a pivot rod 405 having a pivot axis 401 referring to FIG. 4. Each axis 401 is aligned to be generally horizontal when apparatus 100 is positioned on horizontal ground. Accordingly, each arm 121 is configured to pivot (relative to each support 120, sled 104 and main frame 102) in the upward and downward direction (vertical plane) by actuation of each motor 130. As such, each cutting head 128 and in particular the roller cutters 127A, 127B may be raised and lowered along the arcuate path 602 referring to FIG. 6. In particular, each arm 121, head 128 and roller cutters 127A, 127B may be pivoted between a lowermost position 601 and an uppermost raised position 600 with an angle between positions 600, 601 being approximately 150°. When in the lowermost position 601, each roller cutter 127A, 127B and in particular head 128 is suspended in a declined orientation such that a forwardmost roller cutter 127A, 127B is positioned lower than a rearwardmost roller cutter 127A, 127B. According to the specific implementation, this angle of declination is 10°. This is advantageous to engage the cutters 127A, 127B into the rock face at the desired attack angle to create the initial groove or channel during a first stage of the undercutting operation. Additionally, the extensive range of movement of the cutting heads 128 over the rock face is possible due, in part, to axis 401 being separated and positioned forward relative to axis 400 by a distance corresponding to a length of each support 120.

Thus the cutting movement of the apparatus 100 can be conceptualized as comprising two main sub movements. At first, there is a shallow interaction of the cutters 127A, 127B with the rock face towards the mine floor level (often referred to as "sump in"). Here the cut depth is increased from zero to a few millimetres. At this stage each disc body 711A, 711B is approximately parallel with the floor, with the underside 732 facing towards the floor.

The arms 128 then move the head 128 upwards across the rock face 1000. In this stage the disc bodies 711A, 711B are arranged substantially perpendicular to the floor, or are moving towards that orientation, with the underside 732 facing towards the rock face 1000. At this stage, the cut thickness reaches it maximum. This is typically referred to as "shear up". The shear up phase lasts longer in the cutting cycle.

Referring to FIG. 4, each support pivot axis 400 is aligned generally perpendicular to each arm pivot axis 401. Additionally, a rotational axis 402 of each cutting head 128 is orientated generally perpendicular to each arm pivot axis 401. A corresponding rotational axis 704 of each roller cutter 127A, 127B is angularly disposed relative to the cutting head axis 402 so as to taper outwardly in the downward direction. In particular, each roller cutter axis 704 is orientated to be aligned closer to the orientation of each cutting head rotational axis 402 and support pivot axis 400 relative to the generally perpendicular arm rotational axis 401.

Accordingly, each support 120 is configured to slew laterally outward in a horizontal plane about each support axis 400 between the extreme inner and outward positions 501, 502. Additionally and referring to FIG. 6, each respective arm 121 is configured to pivot in the upward and downward direction about arm pivot axis 401 to raise and lower the roller cutters 127A, 127B between the extreme positions 600, 601.

A gathering head 129 is mounted at main frame forward end 303 immediately rearward behind each cutting head 128. Gathering head 129 comprises a conventional shape and configuration having side loading aprons and a generally inclined upward facing material contact face to receive and guide cut material rearwardly from the cutting face (and cutting heads 128). Apparatus 100 further comprises a first conveyor 202 extending lengthwise from gathering head 129 to project rearwardly from frame rearward end 304. Accordingly, material cut from the face is gathered by head 129 and transported rearwardly along apparatus 100.

Referring to FIGS. 1 to 3, a detachable control unit 101 is mounted to the frame rearward end 304 via a pivot coupling 200. Control unit 111 comprises a personnel cabin 110 (to be occupied by an operator). Unit 111 further comprises an electric and hydraulic power pack 114 to control the various hydraulic and electrical components of apparatus 100 associated with the pivoting movement of supports 120 and arms 121 in addition to the sliding movement of sled 104 and the rotational drive of cutting heads 128.

Control unit 101 further comprises a second conveyor 112 extending generally lengthwise along the unit 101 and coupled at its forwardmost end to the rearwardmost end of first conveyor 202. Unit 101 further comprises a discharge conveyor 113 projecting rearwardly from the rearward end of second conveyor 112 at an upward declined angle. Accordingly, cut material is capable of being transported rearwardly from cutting heads 128 along conveyors 202, 112 and 113 to be received by a truck or other transportation vehicle.

In use, apparatus 100 is wedged between the tunnel floor and roof via jacking legs 106, 115 and roof grippers 105. Sled 104 may then be displaced in a forward direction relative to main frame 102 to engage roller cutters 127A, 127B onto the rock face. Cutting heads 128 are rotated via motors 125 that create the initial groove or channel in the rock face at a lowermost position. A first arm 121 is then pivoted about axis 401 via motor 130 to raise roller cutters 127A, 127B along path 602 to achieve the second stage undercutting operation. The first support 120 may then be slewed in the lateral sideways direction via pivoting about axis 400 and combined with the raising and lowering rotation of roller cutters 127A, 127B creates a depression or pocket within the rock immediately forward of the first arm 121 and support 120. The second arm 121 and associated head 128 and cutters 127A, 127B are then actuated according to the operation of the first arm 121 involving pivoting in both the vertical and horizontal planes. This sequential dual pivoting movement of the second arm 121 is independent of the initial dual pivoting movement of the first arm 121. A phasing and sequencing of the pivoting of arms 121 about axes 401 and supports 120 about axes 400 is controlled via control unit 111.

When the maximum forward travel of sled 104 is achieved, jacking legs 106, 115 are retracted to engage tracks 103 onto the ground. Tracks 103 are orientated to be generally declined (at an angle of approximately 10° relative to the floor) such that when ground contact is made, the roller cutters 127A, 127B are raised vertically so as to clear the tunnel floor. The apparatus 100 may then be advanced forward via tracks 103. Jacking legs 106, 115 may then be actuated again to raise tracks 103 off the grounds and grippers 105 moved into contact with the tunnel roof to repeat the cutting cycle. A forwardmost roof gripper 108 is mounted above sled 104 to stabilise the apparatus 100 when sled 104 is advanced in the forward direction via linear actuating cylinder 201.

Although the present invention has been described in connection with a specific preferred embodiment, it should be understood that the invention as claimed should not be unduly limited to such specific embodiments. Furthermore, it will be apparent to the skilled person that modifications can be made to the above embodiment that fall within the scope of the invention.

For example, the number of cutting units 700 included in a cutting head 128 can be different. Typically a cutting head 128 includes between 6 and 18 cutting units, and preferably between 8 and 16 cutting units.

Figure 13:
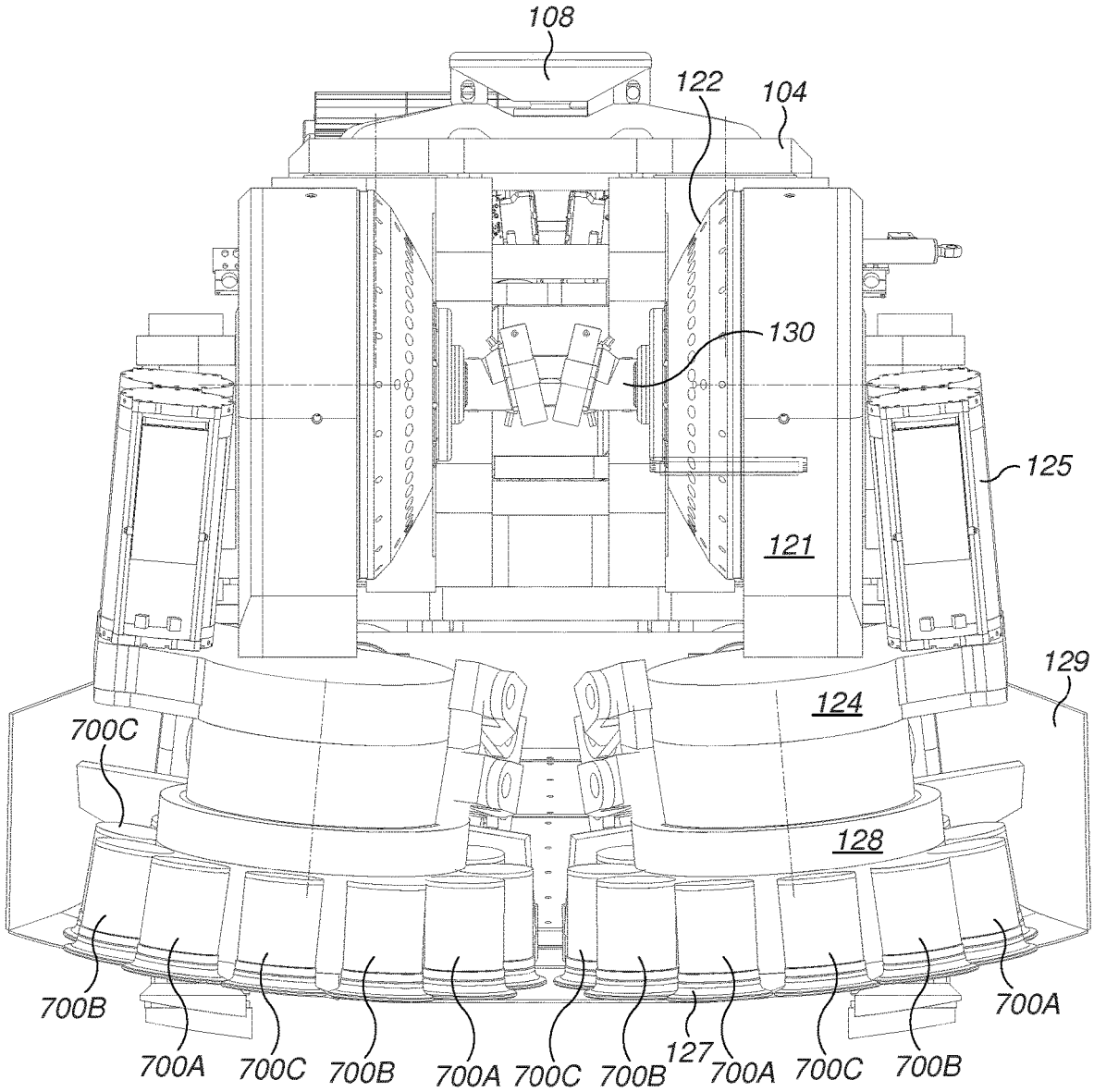
FIG. 13 is a front end view of a mobile cutting apparatus suitable for creating tunnels or subterranean roadways having a forward mounted cutting unit and a rearward control unit according to a second embodiment of the present invention.

The cutter head 128 can include at least one further cutting unit 700C, which is different from the first and second cutting units 700A, 700B. This is shown in FIG. 13. In particular, the arrangement of cutting buttons in the further cutting unit 700C is different from the arrangement of cutting buttons 710A, 710B in the first and second types of cutting units 700A, 700B. Otherwise, the cutting unit 700C is similar to at least one of the cutting units 700A, 700B. It will be appreciated that this enables many different arrangements of cutting units 700A, 700B, 700C around the cutting head 131 that significantly mitigates the tracking problem. For example, the cutting units can be mounted on the cutting head body 131 sequentially around a pitch circle in one of the following arrangements: A, B, C, A, B, C, A, B, C; A, B, C, B, A, C, A, B, C, B, A, C; or A, B, A, C, A, B, A, C, A, B. In preferred arrangements, as the cutting head body 131 rotates, each immediately successive cutter 127 has a different arrangement of buttons 710 from the cutter 127 immediately preceding it. That is, for any given cutting unit 700 mounted on the cutting head body 131, the cutting units 700 immediately adjacent to it on the pitch circle are different from the given cutting unit 700. Thus the cutting unit 700 immediately preceding the given cutting unit in the direction of rotation of the cutting head body 131, and the cutting unit 700 immediately following the given cutting unit 700 in the direction of rotation of the cutting head body, each have a different arrangement of buttons 710 than the given cutting unit 700. This helps to mitigate the tracking problem since the buttons 710 on the successive cutter 127 tend to cut their own paths in the rock face 1000 rather than following paths formed in the rock face 1000 by the cutter 127 immediately preceding it. It will be appreciated that the immediately preceding cutting unit 700 and the immediately following cutting unit 700 can be similar to each other or can be different from one another.

While the buttons 710A, B are shown in the diagrams as having a rounded conical protruding profile, other profiles are possible, such as chisel shaped profiles. In addition, or as an alternative, to the first and second cutters 127A, 127B having a different number of buttons 710A, 710B, the tracking problem can be mitigated by at least one of the following:

The spacing $S_A$ is the distance between the tips of adjacent first buttons 710A (see FIG. 9). The spacing $S_B$ is the distance between the tips of adjacent second buttons 710B (see FIG. 11). The spacing $S_A$ between adjacent first buttons 710A on the first cutter 127A is different from the spacing $S_B$ between adjacent second buttons 710B on the second cutter 127B. In preferred arrangements the spacing $S_A$ between adjacent first buttons 710A is substantially equal around the circumference of the first cutter 127A. In preferred arrangements the spacing $S_B$ between adjacent second buttons 710B is substantially equal around the circumference of the second cutter 127B. This provides cutters 127A, 127B that are easy to manufacture.

The spacings $S_A$, $S_B$ between adjacent buttons 710A, 710B on their respective discs 711A, 711B can be uneven. The spacing $S_A$ between adjacent first buttons 710A can vary around the circumference of the first disc 711A. The spacing $S_B$ between adjacent second buttons 710B can vary around the circumference of the second disc 711A.

Each first cutter button 710A can comprise a first shape. Each second cutter button 710B can comprise a second shape. The first shape is different from the second shape. For example, one of the first and second buttons can have a rounded conical engagement part and the other of the first and second buttons can have a chiselled or pointed engagement part.

The first cutter buttons 710A can have a different size from the size of the second cutter buttons 710B. For example, the parts of the first cutter buttons 710A that engage the rock face 1000 can differ from equivalent parts of the second cutter buttons 710B that engage the rock face 1000 in at least one of the following parameters: height, width, length and volume.

Buttons 710A on each first cutter 127A can have a different angle $\alpha_A$ from the angle $\alpha_B$ for the buttons 710B on each second cutter 127B. In this instance, the angle $\alpha_A$, $\alpha_B$ is set differently for each different type of disc. Preferably the angle $\alpha_A$ for each first type of disc 711A is substantially the same around the circumference of the first disc 711A. Preferably the angle $\alpha_B$ for each second type of disc 711B is substantially the same around the circumference of the second disc 711B. This makes the cutters 127A, 127B easy to manufacture. Preferably the angles $\alpha_A$, $\alpha_B$ are in the range 20° to 34°.

The angle $\alpha_A$ can vary around the circumference of the first disc 711A. That is, every button 710A does not have the same cutting angle $\alpha_A$ on the first cutter 127A, though of course some buttons 710A may have the same angle $\alpha_A$. The angle $\alpha_B$ can vary around the circumference of the second disc 711B. That is, every button 710B does not have the same cutting angle $\alpha_B$ on the second cutter 127B, though of course some buttons 710B may have the same angle $\alpha_B$. Thus the first disc 711A can have a different pattern of angles $\alpha_A$ than the pattern of angles $\alpha_B$ for the second disc 711B. This overcomes the tracking problem, but is more complex to manufacture.

Any combination of the above features.

It will be appreciated that the arrangement of buttons in each further cutting unit 700C can differ from the arrangement of buttons 710A, 710B in the first and second cutting units 700A, 700B, by way of any characteristic described herein, or any combination of characteristics.

The invention claimed is:

1. A cutting head for a cutting apparatus suitable for creating tunnels or subterranean roadways and the like, said cutting head having a cylindrical configuration and comprising:

a rotatable cutting head body;

a plurality of annular shaped roller cutters mounted at a circumferential perimeter of the cutting head and including a sharp annular cutting edge configured specifically for undercutting the rock; and a plurality of cutting units mounted on the cutting head body, the cutting units each having a casing and a shaft, said cutting units including at least first and second different types of cutting units, the first type of cutting unit having a first rotatable cutter including a first disc body and a first arrangement of buttons for abrading rock, said first arrangement of buttons being mounted in a radially peripheral portion of the first disc body and protruding outwardly therefrom, and the second type of cutting unit having a second rotatable cutter having a second disc body and a second arrangement of buttons for abrading rock, said second arrangement of buttons being mounted in a radially peripheral portion of the disc body and protruding outwardly therefrom, wherein the at least first and second different types of cutting units are different from one another by at least the arrangements of the respective buttons, wherein the first rotatable cutter has a number of buttons that is different from a number of buttons of the second rotatable cutter.

2. The cutting head according to claim 1, wherein the plurality of cutting units are mounted on the cutting head body such that, in a direction of rotation of the cutting head, each immediate successive cutter of the first and second cutters has a different arrangement of buttons from the arrangement of buttons of an immediate preceding cutter of the first and second cutters.

3. The cutting head according to claim 1, wherein the plurality of cutting units are mounted on the cutting head body sequentially such that the first and second different types of cutting units alternate in a direction of rotation of the cutting head.

4. The cutting head according to claim 1, comprising at least three cutting units of the first type of cutting unit, and at least three cutting units of the second type of cutting unit.

5. The cutting head according to claim 1, wherein spacing between adjacent buttons on each first cutter is different from the spacing between adjacent buttons on each second cutter.

6. The cutting head according to claim 1, wherein at least some of the buttons on each first cutter have a different shape from a shape of at least some of the buttons on each second cutter.

7. The cutting head according to claim 1, wherein at least some of the buttons on each first cutter have a different size from the size of at least some of the buttons on each second cutter.

8. The cutting head according to claim 1, wherein each cutting unit includes a rotatable shaft having a central longitudinal axis a cutter being mounted on the shaft, wherein at least some of the first arrangement of buttons each have a first central longitudinal axis that subtends a first angle with respect to a reference line that extends perpendicularly from the central longitudinal axis of the shaft, at least some of the second buttons each have a second central longitudinal axis that subtends a second angle with respect to the reference line that extends perpendicularly from the central longitudinal axis of the shaft, and wherein the first angle is different from the second angle.

9. The cutting head according to claim 1, further comprising at least one further type of cutting unit, the at least one further type of cutting unit having a further rotatable cutter having a further disc body and a further arrangement of buttons for abrading rock, said further buttons are mounted in a radially peripheral portion of the further disc body and protrude outwardly therefrom, wherein the further arrangement of buttons is different from the first and second arrangements of buttons.

10. The cutting head according to claim 1, wherein the cutting units are distributed around a pitch circle on the cutting head body.

11. The cutting head according to claim 1, wherein the cutting head body is annular.

12. The cutting head according to claim 1, wherein the cutting head body has a central axis arranged substantially perpendicularly to a plane of the body, wherein each disc body has a central axis that is arranged substantially perpendicular to a plane of its respective disc body, and the central axes of the disc bodies are arranged substantially parallel with the central axis of the cutting head body.

13. A cutting apparatus arranged for creating tunnels or subterranean roadways and the like, the cutting apparatus comprising a cutting head according to claim 1.

* * * * *